US005335614A

United States Patent [19]

Klaus

[11] Patent Number: 5,335,614

[45] Date of Patent: Aug. 9, 1994

[54] FLOORLESS, NON-SELF-SUPPORTING SHIP CABIN, CONSTRUCTED OF PREFABRICATED PARTS AND PROCESS FOR MANUFACTURING AND ERECTING SAME INCLUDING APPARATUS THEREFORE

[75] Inventor: Regul Klaus, Langen, Fed. Rep. of Germany

[73] Assignee: Lloyd Werft Bremerhaven GmbH, Bremerhaven, Fed. Rep. of Germany

[21] Appl. No.: 899,674

[22] Filed: Jun. 15, 1992

[30] Foreign Application Priority Data

Jun. 13, 1991 [DE] Fed. Rep. of Germany ..... 4119422

[51] Int. Cl.[5] ..... B63B 29/02

[52] U.S. Cl. ..... 114/71; 52/79.1

[58] Field of Search ..... 114/71, 189; 52/79.1–79.12, 262, 283, 284, 648.1

[56] References Cited

U.S. PATENT DOCUMENTS

| | | | |
|---|---|---|---|
| 1,452,026 | 4/1923 | Caspary | 114/189 |
| 4,779,552 | 10/1988 | Harsia et al. | 114/71 |
| 4,784,076 | 11/1988 | Carlsson | 114/71 |

FOREIGN PATENT DOCUMENTS

| | | |
|---|---|---|
| 3142124 | 5/1982 | Fed. Rep. of Germany . |
| 8809427 | 9/1988 | Fed. Rep. of Germany . |

*Primary Examiner*—Jesus D. Sotelo

*Attorney, Agent, or Firm*—Trask, Britt & Rossa

[57] ABSTRACT

The invention is directed to a non-self-supporting, floorless ship cabin 21, having wall panels 18*a* which is positioned on a horizontal rigid sliding frame 1. The cabin can be transported, after its fabrication on shore, without difficulty, to a respective position on the deck of a ship. The ship cabin itself need not be rigid due to the sliding frame. This represents a major reduction in weight. The sliding frame 1 together with ship cabin 21 is pulled across the ship deck during transport.

19 Claims, 6 Drawing Sheets

FLOORLESS, NON-SELF-SUPPORTING SHIP CABIN, CONSTRUCTED OF PREFABRICATED PARTS AND PROCESS FOR MANUFACTURING AND ERECTING SAME INCLUDING APPARATUS THEREFORE

A non-self-supporting ship cabin made of prefabricated parts having no bottom floor and a process of manufacture and erection of same, including apparatus to carry out such process is disclosed.

This invention is directed to a non-self-supporting ship cabin made of prefabricated parts having no bottom floor, with U-shape foot sections to fasten the cabin on a ship deck. Vertical wall panels and corner connectors are inserted into the foot sections and connected thereto. Hat sections, in inverse U-shape, having a contact flange, are pushed over the upper edge of the wall panels and corner connectors and connected thereto. Ceiling panels rest on the contact flange and hat sections and are connected thereto. Cogging and connecting elements, particularly groove and spring-type connectors, are slidable in the vertical direction between the wall panels and corner connectors.

Furthermore the invention is directed to a process to manufacture and erect the aforesaid ship cabin including an apparatus to carry out the process.

A system to manufacture ship cabins from pre-fabricated components on board of the ship to be outfitted is already known (DE-GM 88 09 427). On the ship deck, U-shaped sections are interconnected at the locations wherein the composite wall panels and corner connectors are positioned. The individual wall panels and corner connectors are secured against one another by groove and spring-type connectors to produce substantially smooth interior and exterior surfaces. Positioned on the upper edges of the wall panels and corner connectors are hat sections. The hat sections are also U-shaped and have a contact flange on the inside onto which the ceiling panels of the cabin under construction are placed and connected. In addition, on the entrance side of the cabin respective panels defining door frames are provided. These panels are interconnected in a similar way. Finally it is known how to insert self-supporting toilet and shower cabins, fully equipped on land, into such ship cabins.

The construction of ship cabins from pre-fabricated components (wall panels, corner connectors, ceiling panels, foot sections, and hat sections), has major advantages over the individual erection of ship cabins. With little tooling effort, ship cabins of varying size and layout can be manufactured on-site. However, even this erection method still requires considerable time on board, because the pre-fabricated components must be brought on board in individual packing containers. The containers must then be moved to the respective erection site for the cabins, the components must then be uncrated, sorted, and assembled. This not only involves considerable transportation distances, but furthermore the construction crew must walk over the same transportation distances several times during a work day. During work breaks, the crews must walk back to the restrooms and lunch room on shore. This may cause a loss of several hours in productivity per workman per day because of the long distances involved. Furthermore, because of the concentration of construction activities in one small area of the ship, damage is quite likely.

It is already known in the art how to pre-fabricate self-supporting, floorless ship cabins on land (DE-OS 31 42 124) and to lift the fabricated ship cabins aboard ship and transport them along the various decks of the ship by the use of rollers or similar mechanical aids. In such a system, the ship cabins are built very expensively, by having a stable base frame rigidly connected with a head frame through vertical, bolted wall panels in a braced casket form. Such a construction technique inherently involves a considerable increase in the weight of the cabin thereby making it appropriate for passenger ships only to a limited extent. Furthermore, after the erection of the wall modules, the modules can not be removed without damaging them.

The present invention proposes a low weight floorless ship cabin made of pre-fabricated components, which can be pre-fabricated on shore, and stored there. The ship cabin, which can be lifted aboard a ship without major complications is of a quality similar to the pre-fabricated ship cabins known from the prior art.

This objective is solved by the invention for a type of cabin in such a way that a flat slide frame corresponding to the dimensional size of the cabin floor plan is provided which has in the area of the cabin walls longitudinal and crossbeam frame members. In the horizontal plane, the slide frame is stabilized through bracing, in the vertical direction, however, the slide frame is flexible. On the longitudinal and crossbeam frame members of the slide frame the foot sections are preferably attached by tack welding. The wall panels and corner connectors are attached to the foot and hat sections in such a way, that a minor, though not permanent deformation of the rigid ship cabin, is possible within a tolerance range, through movement of the wall panels and corner connectors against each other in a vertical direction, without causing any damage to the components.

Because of the slide frame, such a ship cabin can be moved on deck and be positioned effortlessly, without the need for a rigid cabin frame, which would require greater weight.

In order to be able to move the cabin across minor obstacles without damaging it, the lower and upper ends of the wall panels and corner connectors in the preferred embodiment of the invention are spacedly arranged from the floor of the U-shaped channels of the foot and hat sections. The wall panels and the corner connectors are secured to their respective foot and hat sections at only one point, e.g. in the center of those panels and connectors, by a light weight rivet.

The distance from the bottom of the U-shaped foot section can be created rather easily this way to achieve the required fire protection by inserting elastic distance spacers of insulation material between the lower ends of the wall panels and corner connectors and the bottoms of the U-shaped foot sections.

In the preferred embodiment, the longitudinal and crossbeam frame members of the slide frame include a flat, approximately U-shaped section with inclined legs which is wider than the foot section, with the height of the U-shaped section being the same or less than the thickness of a floor finish to be applied later inside the ship cabin. In this way a totally level subsurface is created, without any protrusions, onto which a carpet or other floor covering can be installed. To facilitate the attachment of braces to the slide frame in a simple fashion, a section is attached to the inner legs of the flat U-shaped sections of the slide frame, parallel to the floor section, to interconnect with the braces either directly or by means of a joining plate. These braces are only needed during the construction of the cabin on shore and until the ship cabin has been moved to its final position and the slide frame has been connected to the deck, i.e. by welds. The braces are then removed, i.e. cut off, or preferably unscrewed to facilitate their reuse. In this way the interior of the cabin is cleared of the braces in order to permit the application of the final floor finish.

Tension and compression lugs, which can be removed, if necessary, after the attachment of the sliding frame to the deck, are arranged at stable points on the exterior surface of the sliding frame. Using these tension and compression lugs allows one to manoeuvre the sliding frame together with the ship cabin.

In such a furnished ship cabin, a self supporting toilet and shower cell (prior art) can be erected on the sliding frame which supports the cabin walls and can be transported with the other components. The toilet and shower cell is integrated into the ship cabin and attached to suitable longitudinal and crossbeam frame members of the sliding frame.

In the case where the wall panels and corner connectors are arranged with their lower and upper ends positioned at the distance from the respective floors of the U-shaped foot and hat sections and are attached to those sections at only one point in order to facilitate opposing movement between the wall panels and the corner connectors in case of a deformation of the ship cabin, additional fixtures, attached horizontally to the cabin walls over several wall panels, such as cable conduits, are connected at a single mid-point of each wall panel by means of vertically oriented, slotted holes.

It is obvious that for such a process the most time consuming fabrication steps, i.e. the fabrication of the ship cabins, including the installation of electrical cables, air conditioning, and furniture and fixtures which are attached to the walls and ceilings, can be done on shore which, in case of a later refurbishment, would minimize the delays the ship has to remain in the ship yard. The pre-fabrication of the ship cabins on shore saves considerable walking distance for the work crew, not only with respect to the supplies, but also for getting to the work place and during breaks, since the lunch and rest rooms are located close by. This would not be possible on board the ship.

In order to transport ship cabins, fabricated according to this design, easily and without damage, after the ship's arrival at the ship yard, the transportation frame has two longitudinal beams, between which a platform has been arranged. The platform is stiffened by cross braces and bottom plates, and the platform has at both ends a sloped ramp ending at the bottom edges of the longitudinal beams.

The transportation frame is preferably equipped with transport lugs for pick-up by a crane and/or guide rails to positively lock the transport frame to the respective outer supports of a truck, particularly a semi trailer. In order to be able to pull the ship cabin from the one or the other end through the ship hull, the transportation is built in form of a see-saw with a horizontal axis in the cross direction (lateral direction). The platform itself has a curve shaped form and adapts well to the deformed ship cabin during transport. The prescribed curvature prevents a permanent deformation of the flexible ship cabin.

In a preferred embodiment the bottom sides of the longitudinal beams in the transport frame form a see-saw in a cross direction and the platform is curved in the same direction towards the center of these two sloped support areas of the longitudinal beams, whereby the maximum bending does not exceed the maximum permissible deformation of the ship cabin.

Furthermore, in order to position the transport frame together with the ship cabin onto the ship, a platform is provided which can be temporarily attached to the hull of the ship and which has on the upper side on both sides slip in pockets (recess wells) into which the front ends of the longitudinal beams of the transport frame can be moved for fixation.

The invention is described by use of the following described embodiments and by reference to the attached drawings.

Figure 1:
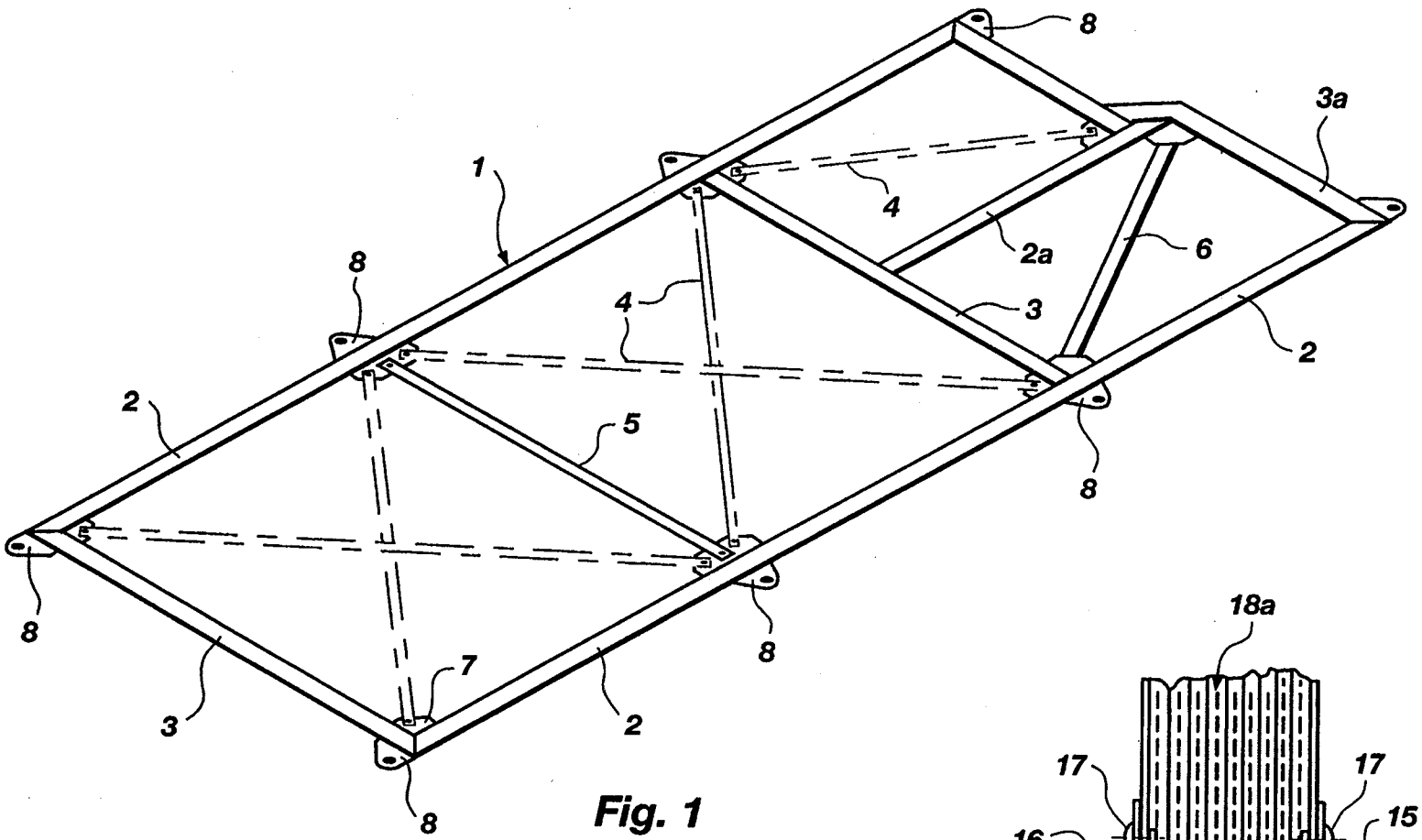
FIG. 1 is an elevated perspective view of a sliding frame for the erected ship cabin.
Figure 2:
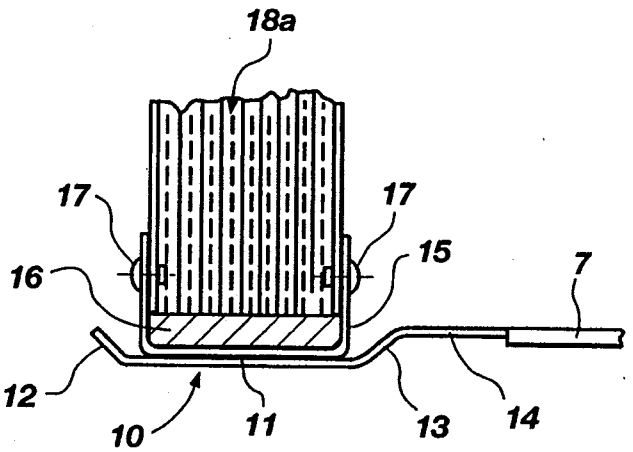
FIG. 2 is a cross-sectional view taken of the sliding frame section with erected foot section and attached wall panel.

In FIG. 1 a sliding frame 1, which has been adapted to the cabin floor plan, is illustrated. The sliding frame has longitudinal frame members 2 and crossbeam frame members 3 at the locations where the cabin walls 18 (see FIG. 3) are to be erected. These longitudinal and crossbeam frame members 2 and 3 form the foundation for the ship cabin. FIG. 2 illustrates that the longitudinal and crossbeam frame members 2 and 3 of the sliding frame, have a flat U-shaped section 10, including bottom 11 and two inclined legs 12 and 13. The section 10 is curved and legs 12 and 13 are inclined in order to facilitate an easy gliding of sliding frame i also across minor obstacles. The U-shaped section 10 also includes an extension of the inner leg 13 of sliding frame 1. This extension, in the form of a sectional leg 14, is positioned parallel to bottom 11 and serves not only to stiffen sliding frame 1 in the horizontal plane but also to secure braces 4,5, and 6 which are connected by means of connector plates 7. The connector plates are made of thicker material, or are directly connected to the U-shaped section 10 of sliding frame 1.

Figure 3:
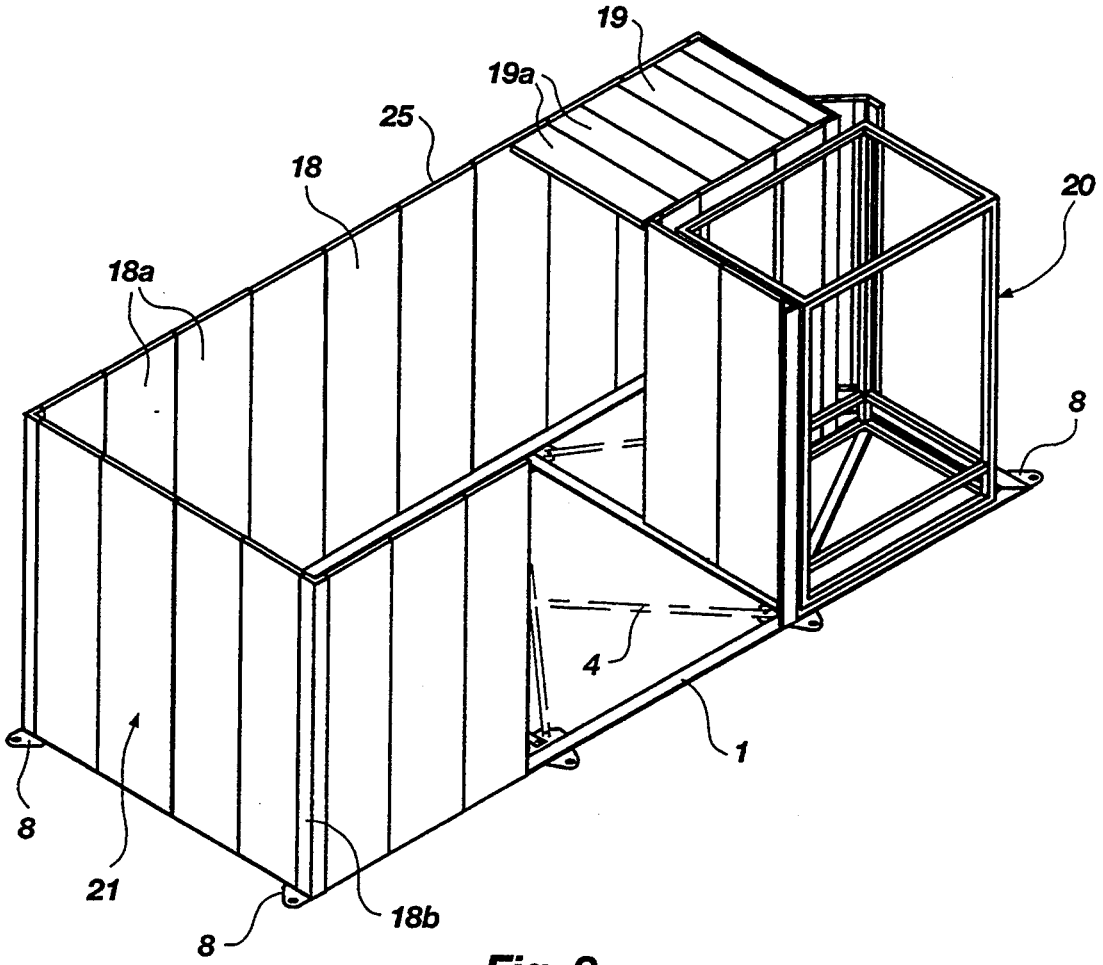
FIG. 3 is an elevated perspective view of a ship cabin erected on a sliding frame and almost completed.

Braces 4 and 5, illustrated by dotted lines in FIG. 1, extend in diagonal directions transverse to the longitudinal frame members 2. Braces 4 and 5 are only needed during the erection phase of the ship cabin and the transport use of the sliding frame 1. As soon as the sliding frame 1 is attached to the ship deck, e.g. through welding, braces 4 and 5 can be removed to make room for the application of a floor finish in the completed ship cabin 21 (FIG. 3). Braces 4 and 5 can therefore be made very strong since they are not in the way later on. They are preferably screwed to connector plates 7. This facilitates their removal and later reuse. This temporary connection is facilitated by the fact that the section leg 14 is positioned at the side of the U-shaped section 10 and is configured to define a space between it and floor 11 (see FIG. 2).

Figure 4:
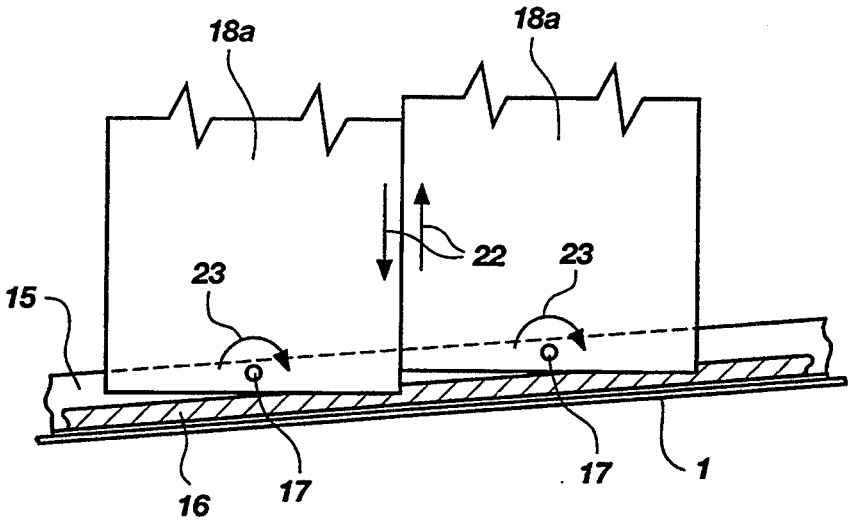
FIG. 4 is a schematic view of the connection of the lower wall panel sections in the foot section.
Figure 9:
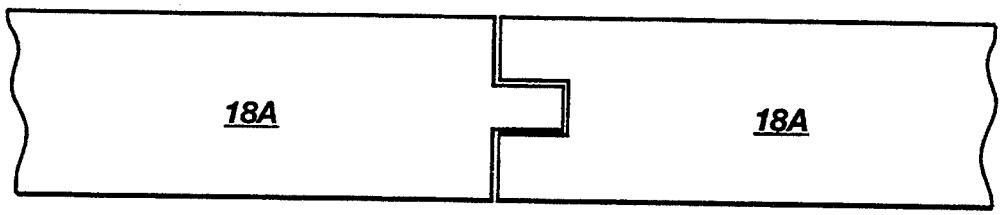
FIG. 9 is a top view of two wall panels connected to one another by means of a cog or cogged joint, specifically a mortise and tenon joint.

As can be seen from FIGS. 2 and 4, a U-shaped foot section 15 is attached to the U-shaped section 10 of sliding frame 1, preferably by tack welds. Wall panels 18*a* of cabin walls 18 are held together between the two legs of U-shaped foot section 15, by corner connectors 18*b*. The wall panels 18*a* may be connected to one another by means of a cogging or a connector which are movable in a vertical direction, between the wall panels and the corner connectors. As shown in FIG. 9 a cogging or cog may include a tenon formed on the face or side of one wall panel 18*a* which is received into a mortise in another wall panel 18*a* to secure the two wall panels together. The lower edges of panels 18*a* are not in direct contact with the bottom of foot section 15. Instead a gap is defined between the lower edges of the cabin wall panels 18*a* and the floor of the foot section 15. A spacer strip 16, formed of elastic insulation material, is inserted in the gap defined between the lower ends of panels 18*a* and the foot section 15. The lower areas of wall panels 18*a* are connected by means of pop rivets 17 with the legs of foot section 15. As FIG. 4 shows, this connection of each wall panel 18*a* to the foot section 15 is effected at only a single location. This location is positioned at the approximately mid point of the panel's width. With the sliding frame 1 positioned at an inclined orientation, e.g. when the sliding frame is moving across an obstacle, this convention allows a rotation of wall panels 18*a* in the direction of arrows 23 with a corresponding simultaneous opposite displacement of the wall panels 18*a* in the direction indicated by arrows 22. In this way a deformation of the completely erected ship cabin 21 (FIG. 3) is possible without any damage to the wall panels 18*a*. During the deformation of the ship cabin, the lower edges of wall panels 18*a* compress and indent the elastic spacer 16, without themselves being damaged.

In FIG. 3 an upper hat section 25 is also indicated, which has a similar shape as the foot section 15 (FIG. 2), but is arranged in an opposite orientation i.e. the hat section is inverted. A flange is attached to the leg of the hat section 25 which faces the inside of the ship cabin. Ceiling panels 19*a* of cabin ceiling 19 are positioned on the flange and attached thereto in a suitable manner. This hat section 25 is simply placed on the upper edges of wall panels 18*a* and attached thereto. The attachment is done in the same way as previously described for the foot sections 15 (FIG. 4), i.e. the top edge of the wall panels is positioned at a distance from the inverted bottom of the U-section of the hat section. In this construction, no spacer strip 16 is positioned between the top edge of the panel and the hat section, i.e. the upper areas of the wall panels 18*a* are attached with a pop rivet only, at about the mid-point of each respective wall panel, in order to facilitate a rotation of the cabin wall about the connection point and the movement of wall panels 18*a*.

FIG. 3 also shows a toilet and shower cell 20 in a corner of ship cabin 21, indicated by a rigid frame construction. This toilet and shower cell is arranged on longitudinal frame members 2 and 2*a* as well as cross beam frame members 3 and 3*a*. A diagonal brace 6 is also provided. Cross brace 6 does not have to be removed after the transport and positioning of the ship cabin, since the toilet and shower cell 20 is already fully equipped and has its own flooring.

Tensile and compression lugs are welded, at suitable, stable locations along sliding frame 1. These lugs are directed upwardly at an angle. The lugs facilitate either a pulling or pushing of the sliding frame while the ship cabin 21 is positioned on it. These tensile and compression lugs can be removed quite easily after the erection of the cabin in the event they are in the way.

Figure 5:
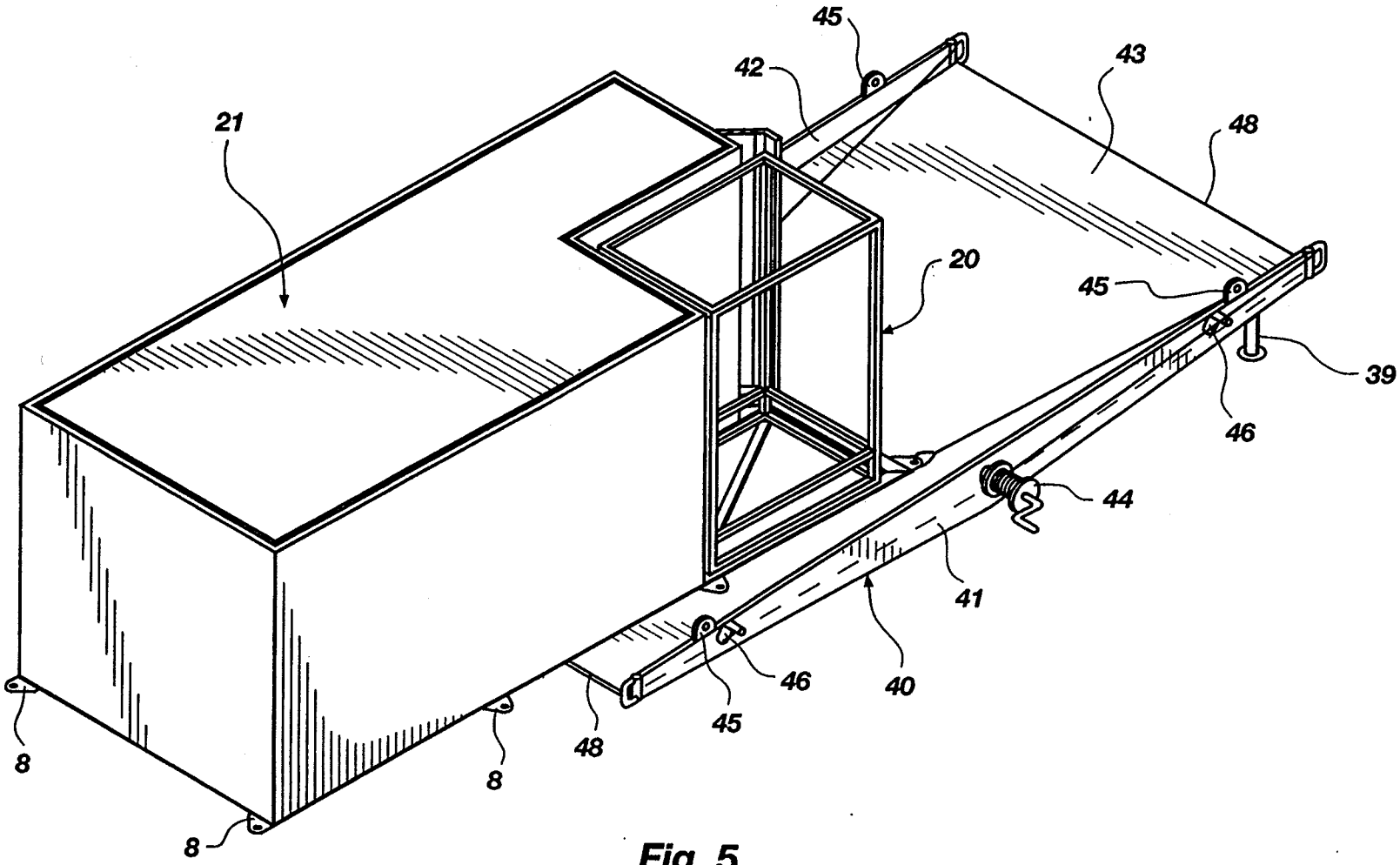
FIG. 5 is an elevated perspective view illustrating the pulling of a finished ship cabin onto the transport frame.

FIG. 5 illustrates a method of pulling a ship cabin, which has been completed on shore, onto transport frame 40. This transport frame (see FIG. 6) comprises two longitudinal beams 41 and 42 which are interconnected by a platform 43. The transport frame is rigid. By means of suitable crane lifting devices, the transport frame together with ship cabin 21, can be lifted and transported through intermediation of transportation lugs 45. The pulling of ship cabin 21 onto transport frame 40 can be done using two cable winches 44, which are schematically indicated. From FIGS. 5 and 6, it can be seen that the longitudinal beams 41 and 42 are provided with guide rails 46 which allow the transport frame 40, including the ship cabin 21 associated therewith, to be moved onto the respective supports 47 of a semi tailer 50 or similar transportation means in a fixed and stable way. Additional jacks 39 are provided.

Figure 6:
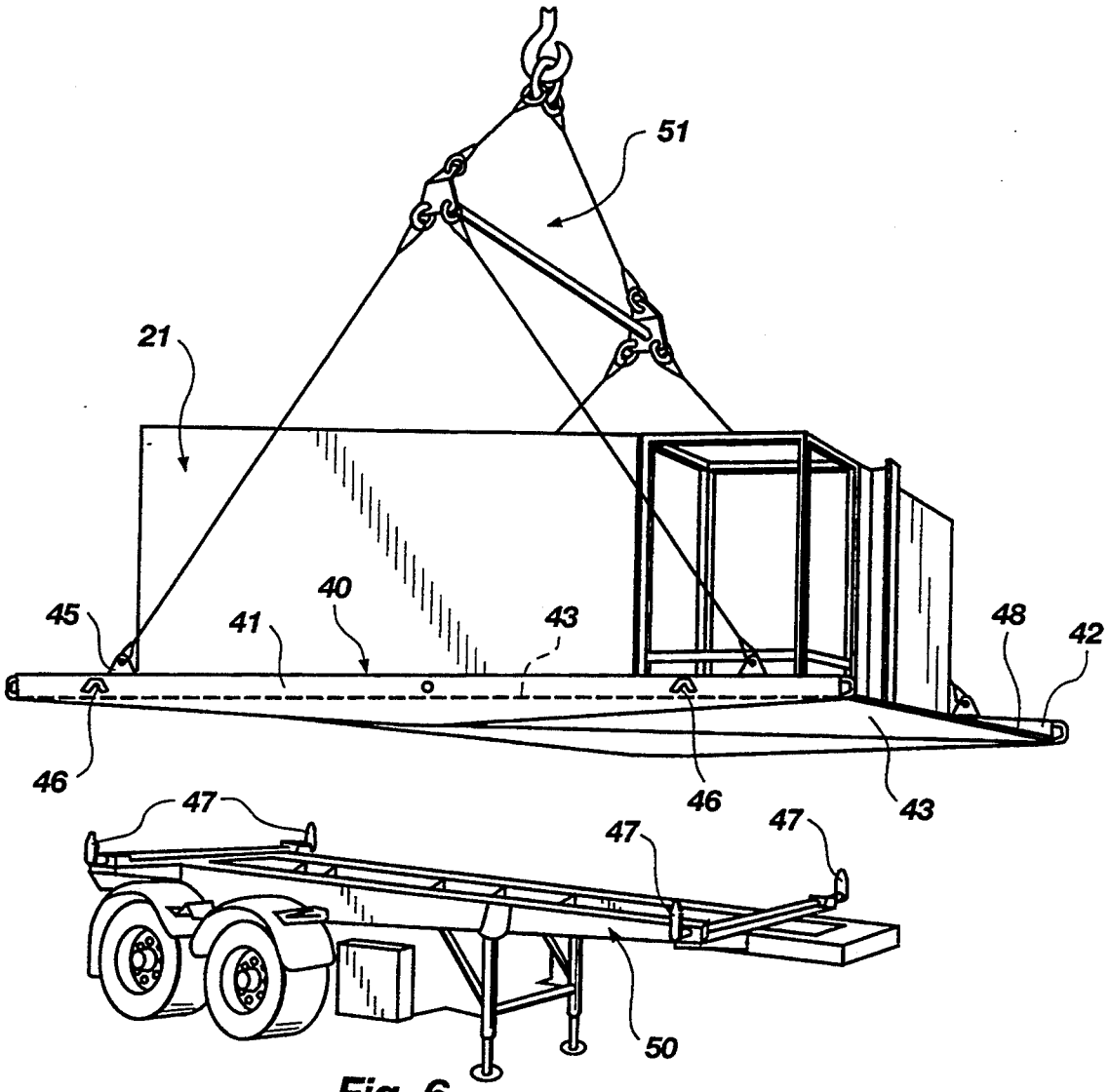
FIG. 6 shows the transport of a ship cabin, positioned on a transport frame, by crane onto a semi trailer.
Figure 7:
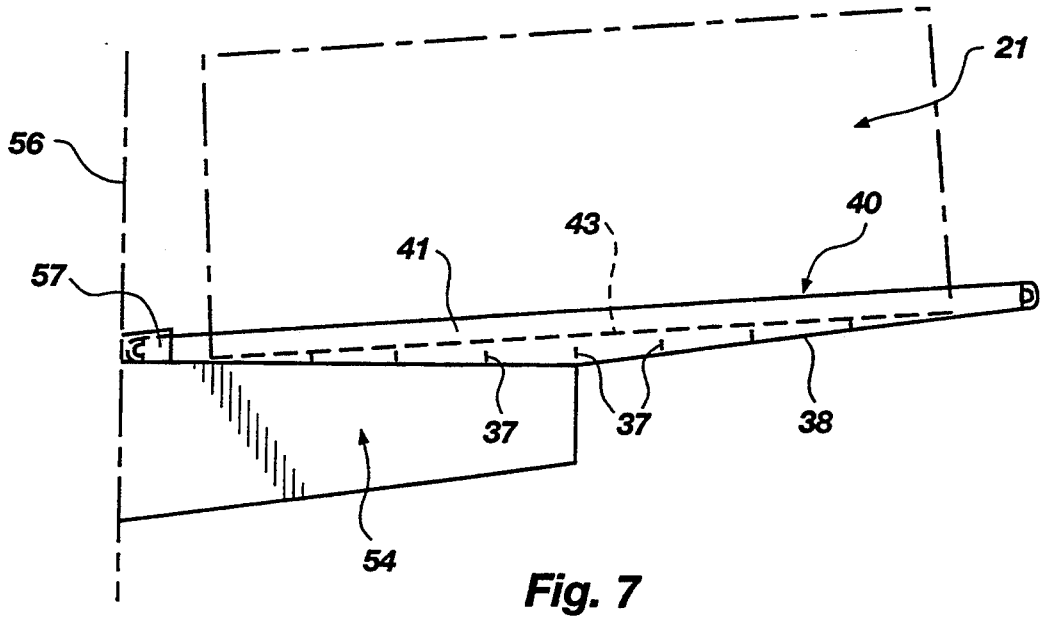
FIG. 7 shows details of the transport frame and the platform.

As can be seen from FIGS. 6 and 7, the lower support areas of the longitudinal beams 41 and 42 are sloped in such a way that the transportation frame 40 forms a see-saw-like structure when placed on a horizontal plane. Platform 43, positioned between longitudinal beams 41 and 42, does not form a flat surface, but is curved towards the lower edges of longitudinal beams 41 and 42, as shown in FIGS. 6 and 7 by the broken lines. The curvature of platform 43 corresponds to the maximum allowable deflection of ship cabin 21 achievable without causing any damage to individual components of the cabin.

When the ship cabin 21, is positioned on the sliding frame 1 on a horizontal surface and the sliding frame is lifted at one end, the sliding frame 1 bends or deflects together with the ship cabin 21 pursuant to a pre-determined deflection curve. It is important that the lifting and the deflection distances do not exceed certain values, otherwise permanent deformations and damage could result. If the platform 43 of transportation frame 40 is adapted to the deflection curve of the ship cabin 21 and is moved beneath the lifted cabin (alternatively, the lifted cabin 21 may be pulled onto the stationary transportation frame 40), the ship cabin 21 can subsequently be transported by lifting transportation frame 40.

Since the ship cabin 21 is to be lifted, the platform 43, at a distance from the firmly rested end of the ship cabin, defines a certain vertical distance above the support surface (ground), which can be used for cross braces for the transportation frame 40. Since the braced interval between platform 43 and the contact areas of transportation frame 40 at the lifted end is not fully needed, the transportation frame 40 can be built in a preferred construction of the invention as a see-saw, whereby the braced interval between the platform 43 and the contact areas is the greatest in the middle and decreases towards the ends (edges 48). In this way it is possible to pull the ship cabin 21 from both sides onto transportation frame 40 and also to pull it off again.

With a lower edge 48 (FIG. 6) at the ends of transportation frame 40, the sloping of the contact areas of the longitudinal beams 41 and 42 results in the vertical distance between the platform 43 and the lower edges of the longitudinal beams 41 and 42 becoming greater towards the middle of the frame. This allows one to configure the cross braces 37 which extend between platform 43 and bottom plates 38 to be sufficiently strong. The necessity for bracing requires that that portion of the platform 43 located in the middle section of transportation frame 40 be positioned at a greater distance from or a greater height above the contact areas of transportation frame 40.

In order for the ship cabin to be moved on or off of the transportation frame 40 over the leading edge 48, the transportation frame 40 has been designed as a see-saw, as already mentioned. This allows the frame together with the ship cabin to rotate, either to the one or the other side, in order to get a respective leading edge 48 onto the ground.

Figure 8:
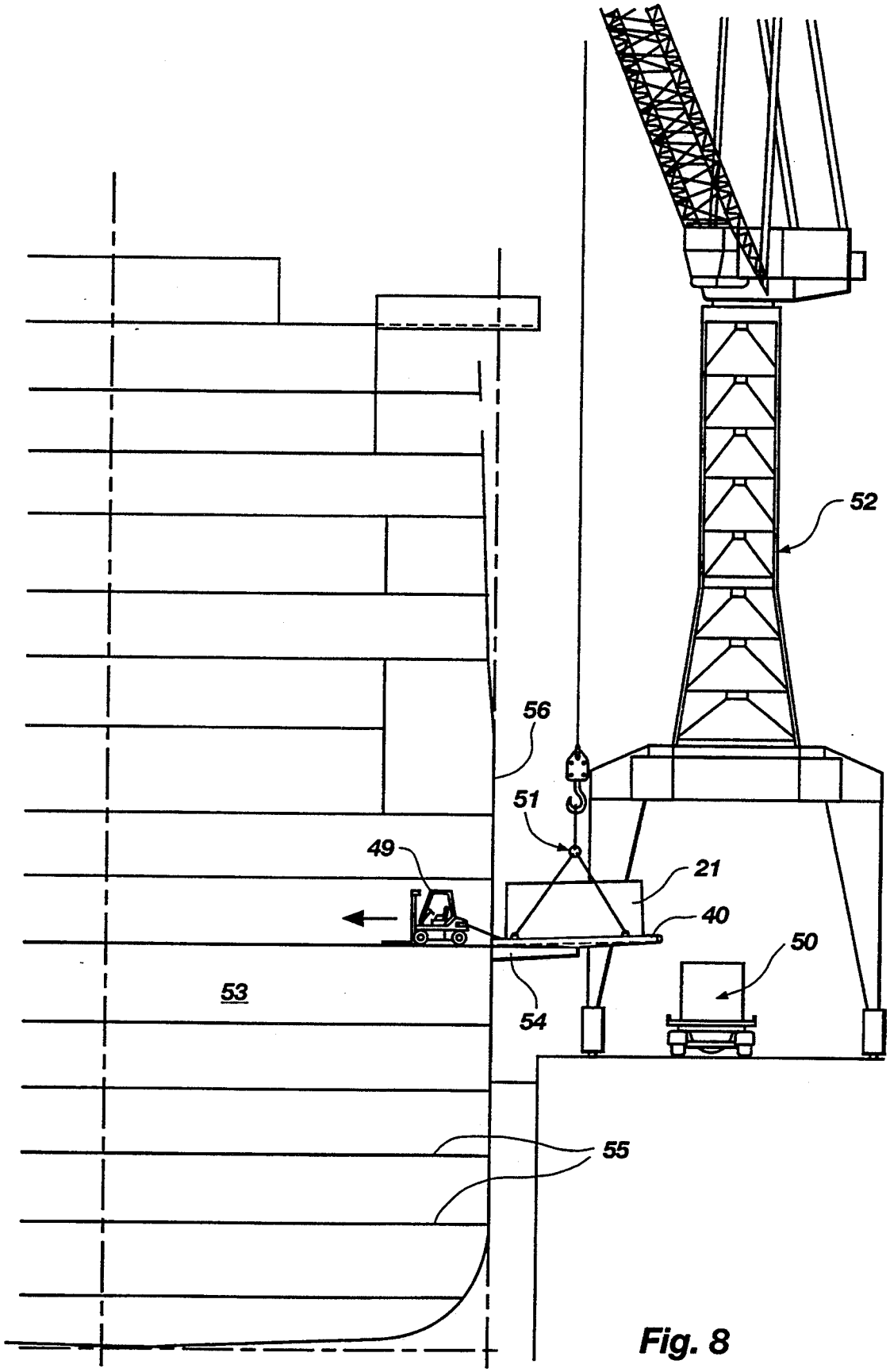
FIG. 8 shows the transport of a ship cabin on a transport frame by means of a crane onto a ship deck.

FIG. 8 illustrates how ship cabin 21 may be positioned on the transportation frame 40 to facilitate its being lifted by means of lifting devices 51 and crane 52 onto a platform 54, which has been welded to the hull 56 of a ship 53 at a suitable elevation. In order to transport ship cabin 21 onto the desired deck 55, a suitably large hole (not shown) is cut in the hull for this purpose. After the ship cabin 21 has been pulled off of the transportation frame 40, it is pulled through the hole with a forklift. In this way all ship cabins 21 can be transported over the shortest possible distance to a desired deck 55.

FIGS. 7 and 8 illustrate that platform 54 is dimensioned to have only half the length of the transportation frame 40. The short length of platform 54 facilitates the passage of crane 52, as shown in FIG. 8.

In order for the transportation frame 40 to be securely positioned on platform 54, recess wells are arranged in the area of the ship hull 56 on both sides of platform 54 into which the ends of longitudinal beams 41 and 42 of transportation frame 40 can be inserted and secured. In this way, the transportation frame 40 is securely positioned on platform 54. No further security precautions are then required during the pulling of ship cabin 21.

The ship cabin and the associated method of its manufacturing process, including attendant apparatus, is of great advantage for both the refurbishment of existing ships and new constructions. However, it is most valuable during refurbishment since in this way, the refurbishment time in a ship yard can be kept to a minimum and the refurbished ship can be launched again within a short time frame.

I claim:

1. A non self-supporting, floorless ship cabin made of prefabricated components comprising:

U-shaped foot profiles adapted for connection to a ship deck;

vertical wall panels and corner connectors, inserted into and connected to said foot profiles;

hat profiles in inverse U-shape, each said hat profile having a contact flange, positioned and connected to an upper edge of a respective said wall panel and corner connector;

ceiling panels positioned on and connected to said support flange of said hat profiles; and a flat sliding frame dimensionally corresponding to the size of a cabin's floor plan, said flat sliding frame having longitudinal and crossbeam frame members, said sliding frame being rigified in a horizontal plane by braces, while being flexible vertically with respect to said horizontal plane;

wherein said foot profiles are attached to said longitudinal and crossbeam frame members, preferably by tack welds, and said wall panels and said corner connectors are connected to said foot profiles and said hat profiles in such a way that a minor non-permanent deformation of the nonrigified ship cabin is possible within certain limits by allowing a movement of said wall panels and said corner connectors in a vertical direction and opposite to each other without causing damage to said wall panels and said corner connectors.

2. The ship cabin according to claim 1, wherein said wall panels and said corner connectors are arranged with their lower and upper ends at a distance the bottoms of said U-shaped foot profiles and said hat profiles and said wall panels are only connected at one location, preferably at their middle point, by means of pop rivets.

3. The ship cabin according to claim 2, wherein an elastic strip made of insulation material is inserted between each said lower end of said wall panels and of said corner connectors and said bottoms of said U-shaped foot profiles.

4. The ship cabin according to claim 1 wherein said sliding frame has been prepared to be welded to said deck.

5. The ship cabin according to claim 1 wherein longitudinal and crossbeam frame members of said sliding frame are fabricated to have a flat U-shaped profile with inclined legs which are spaced apart from one another a distance greater than a width of said foot profile, and wherein a height of said U-shaped profile is equal to a thickness of a flooring finish to be applied later on said deck inside of said ship cabin.

6. The ship cabin according to claim 5 wherein said sliding frame includes a plurality of extensions connected to said inclined legs, said extensions being positioned parallel to a bottom of said U-shaped profile of a respective said frame member, said extensions providing a means to connect said braces to said sliding frame.

7. The ship cabin according to claim 1 wherein said braces are removably attached to said sliding frame preferably by screws, which can be removed after connection of said sliding frame to said deck.

8. The ship cabin according to claim 1 wherein tensile and compression lugs are attached to the outside surface of said sliding frame at rigid positions, said lugs being removable after a connection of said sliding frame to said deck.

9. The ship cabin according to claim 1 wherein a self supporting toilet and shower cell are integrated into said ship cabin and are connected to suitably arranged additional longitudinal and or crossbeam frame members of said sliding frame.

10. The ship cabin according to claim 1 wherein additional fixtures such as conduits if extending in a horizontal direction over several wall panels are attached only at a single mid point of each wall panel at slotted holes therein which increase in size in a vertical direction.

11. The ship cabin according to claim 1 further comprising:

a transportation frame having two distinct longitudinal beams between which a platform is arranged, said platform being braced by transversal braces and bottom plates, said platform having at each of its ends a flat edge which reaches to the bottom edges of said longitudinal beams, said sliding frame being positioned on said transportation frame.

12. The apparatus according to claim 11, wherein said transportation frame is equipped with transport lugs for attachment to a crane.

13. The apparatus according to claim 11 wherein lower flanges of said longitudinal beams of said transportation frame form a see-saw with a rotational axis in a cross direction and a platform having two inclined support areas formed by said longitudinal beams, said platform being curved in a same direction towards the middle, whereby a deflection thereof is compatible with a maximum allowable deformation of said ship cabin.

14. The apparatus of claim 11, wherein a second platform is provided on a ship to allow placement of said transportation frame together with a ship cabin, said second platform having been attached temporarily at a hull of said ship and having on both sides spacedly arranged, into which front ends of said longitudinal beams of transportation frame can be inserted and secured.

15. The apparatus according to claim 11, wherein said transportation frame is equipped with transport lugs for attachment to guide rails for securing it rigidly to respective supports of a truck, particularly a semi-trailer.

16. The ship cabin according to claim 1 wherein longitudinal and crossbeam frame members of said sliding frame are fabricated to have a flat U-shaped profile with inclined legs which are spaced apart from one another a distance greater than a width of said foot profile, and wherein a height of said U-shaped profile is smaller than a thickness of a flooring finish to be applied later on said deck inside of said ship cabin.

17. The ship cabin according to claim 1 further including connectors which are movable in a vertical direction between said wall panels and said corner connectors.

18. The ship cabin according to claim 17 wherein said connectors are cogs.

19. A process for fabricating and erecting ship cabins comprising:

fabricating a sliding frame outside of a ship, including longitudinal and crossbeam frame members and associated braces;

erecting said ship cabin from wall panels, corner panels, foot profiles and hat profiles on said sliding frame;

pulling or pushing said sliding frame together with said ship cabin onto a rigid transportation frame;

transporting said transportation frame together with said ship cabin to a ship;

pulling or pushing said sliding frame together with said ship cabin from said transportation frame and pulling and pushing said sliding frame together with said ship cabin through an opening of said ship to a final location, mounting said sliding frame together with said ship cabin to a ship deck;

removing said braces; and executing finishing work on said ship deck.

* * * * *